United States Patent [19]

Johnson

[11] 4,048,819

[45] Sept. 20, 1977

[54] KNITTED GARMENTS

[75] Inventor: Martin Robert Johnson, Broughton Astley, England

[73] Assignee: Ridley, Spriggs and Johnson Limited, England

[21] Appl. No.: 568,440

[22] Filed: Apr. 16, 1975

[30] Foreign Application Priority Data

Apr. 25, 1974 United Kingdom ..... 18039/74
July 12, 1974 United Kingdom ..... 30976/74

[51] Int. Cl.[2] ..... A41B 9/02; A41B 9/04; A41B 9/10

[52] U.S. Cl. ..... 66/177; 66/172 E

[58] Field of Search ..... 66/172 R, 172 E, 175, 66/176, 177, 196, 191, 193, 169, 170, 171

[56] References Cited

U.S. PATENT DOCUMENTS

| | | | |
|---|---|---|---|
| 3,392,553 | 7/1968 | Burleson | 66/172 E |
| 3,422,641 | 1/1969 | Skrepek | 66/172 |
| 3,859,825 | 1/1975 | Foulguies et al. | 66/192 |
| 3,875,768 | 4/1975 | Arndt | 66/172 R |

FOREIGN PATENT DOCUMENTS

| | | | |
|---|---|---|---|
| 1,243,506 | 8/1971 | United Kingdom | 66/177 |

*Primary Examiner*—Ronald Feldbaum
*Attorney, Agent, or Firm*—Edelson and Udell

[57] ABSTRACT

A knitted garment wherein a walewise extending free edge consists of a folded over edge portion automatically produced during knitting of the garment. Such folded over edge portions may finish the leg openings of briefs, or the waist opening of one-piece tights. The invention includes a preliminary seamless tubular blank which, when slit and opened out, provides a final blank for making-up into briefs. The preliminary blank has a visible cutting line extending from end to end and at opposite sides of which are provided two automatically produced folded over edge portions — initially side-by-side. The folded over edge portions are folded by contraction of floats of yarn which extend coursewise over a number of knitted loops in spaced courses of the fabric margin.

9 Claims, 13 Drawing Figures

KNITTED GARMENTS

Figure 1:
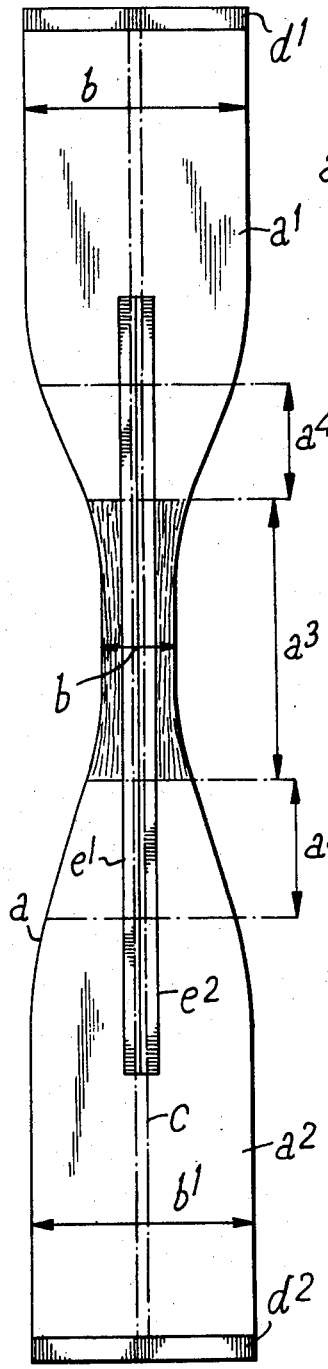

This invention relates to knitted garments, and has reference particularly to such garments in which there are produced, during the knitting operation, walewise extending free non-run edges defining, or in part defining, openings into the garment.

The invention may be, and will for convenience hereinafter be largely described as being, applied to knitted briefs — in particular a pair of briefs of a form proposed by us and which are produced from a preliminary seamless tubular blank knitted by rotary knitting on a circular seamless hose machine, said preliminary tubular blank being (a) waisted at a location between its initially aligned opposite ends suchwise as to provide a crotch portion which, although knitted on nearly all the needles of a circular set, is of substantially reduced diameter, the coursewise constriction constituting the waisting resulting from the incorporation of contrasting yarns of respectively different types or/and deniers in conjunction with stitch variations and, if desired, also changes in stitch quality, and (b) capable of being readily slit walewise from end to end and opened out into a final brief blank of flat form.

Such a waisted form of preliminary tubular blank, after it has been slit walewise and opened out into a final one-piece brief blank of flat form is folded in half along a transverse, i.e. coursewise extending, line near to the relevant end of the crotch portion, whereupon the appropriate cut portions of the two halves adjoining the opposite ends of what is to form the waist band of the garment are seamed together, the crotch portion being left in the form of a loop to close the nether region of the garment between the two leg openings.

Now, in the ordinary way, were those free edges of the aforementioned one-piece brief blank which are to define the leg openings not specially knitted during production of the waisted preliminary tubular blank, they would, as a consequence of slitting the said preliminary blank, be left ragged, and possibly also with a tendency to roll over or curl, thereby in any event necessitating subsequent finishing of these edges by the application thereto of appropriate finishing material.

The invention may also be applied to, say, one-piece tights comprising a pair of complete circularly knitted legs and feet which are integrally knitted on to a brief, i.e. body portion, which has a suitably reinforced crotch portion between the legs and a waist opening.

One-piece tights are nowadays commonly knitted on a circular hose machine with the two legs and the intermediate brief or body portion knitted in line walewise and drawn off the machine in this way. Thus, first one foot portion and the corresponding leg are knitted circularly, next the brief or body portion is knitted either wholly by continued rotary knitting or partly by rotary knitting and partly by a change to reciprocatory knitting to produce the part of the brief or body portion having therein a walewise extending waist opening, and finally the other leg and its foot portion are circularly knitted.

If the brief or body portion of such one-piece tights is knitted circularly, then unknitted portions of floating yarn which, if they were not cut away, would connect the walewise extending free edges defining the waist opening, are, in fact, systematically and automatically cut out, thereby not only causing these edges to have a ragged appearance lacking neatness but also allowing the said edges to roll over or curl.

Rolling over or curling of the free edges similarly takes place if and when, alternatively, the part of the brief or body portion which is to have therein a walewise extending waist opening is produced by reciprocatory knitting.

In both of these prior methods of producing one-piece tights, the marginal portions of fabric adjoining the free edges which define the waist opening are usually reinforced by splicing. In the finished garment this spliced reinforcement encircles the top of the brief or body portion and constitutes a waistband. In the event that such a waistband is knitted of an elastomeric yarn, the tendency to curl in an uncontrolled manner is sometimes all the more noticeable.

The general object of the present invention, therefore, is to produce on the relevant free edges of knitted garments, and especially knitted garments having therein walewise extending openings, improved formations which have a particularly neat and flat appearance and virtually no tendency to curl — thereby obviating the necessity for any subsequent finishing of such edges.

A particular aim of the invention is to achieve this general object in respect of edges which are to define the leg openings of a pair of knitted briefs of the hereinbefore described proposed form.

According to this invention a walewise extending free edge portion of a knitted garment is automatically folded over and down and anchored during knitting of the garment. In general appearance but not, of course, in construction such a walewise extending folded over edge portion is like a relatively small turned welt. But whereas a turned welt extends coursewise, a folded over edge portion automatically produced on a knitted garment according to this invention extends walewise.

It is principally the intention that the said walewise extending folded over edge portion shall be one defining or assisting to define, an opening in the knitted garment.

Essentially, the fold in the folded over edge portion is effected by virtue of the yarn, or one of the yarns, incorporated into the margin of fabric adjoining the walewise extending free edge being floated inwardly from knitted loops bordering said edge and coursewise over a predetermined number of knitted wales in each of regularly spaced courses.

The idea is that the coursewise extending float threads, in tending to contract into the main body of the knitted fabric, draw knitted loops bordering the free walewise extending edge inwardly, thereby tuning the marginal edge fabric over and down into a neat fold. The resulting inwardly directed outer portion of the substantially flat folded edge so produced is firmly anchored to the main body of the fabric by the float threads. It will, therefore, be appreciated that the folded over edge portion extends at right angles to and across the courses instead of along the courses as in the case of a turned welt.

In practice, it will usually be found that the float threads will be sufficiently long to effect the required fold in the fabric without being otherwise inconveniently too long, if they are each floated over about nineteen successive needles: there is, however, no limitation in this respect.

If elastication is required, then the walewise extending folded over edge portions may be knitted of a stretch, e.g. elastomeric, yarn or yarns.

Splicing, i.e. additional, yarns may advantageously be introduced to reinforce or/and elasticate the walewise extending folded over edge portions.

Figure 2:
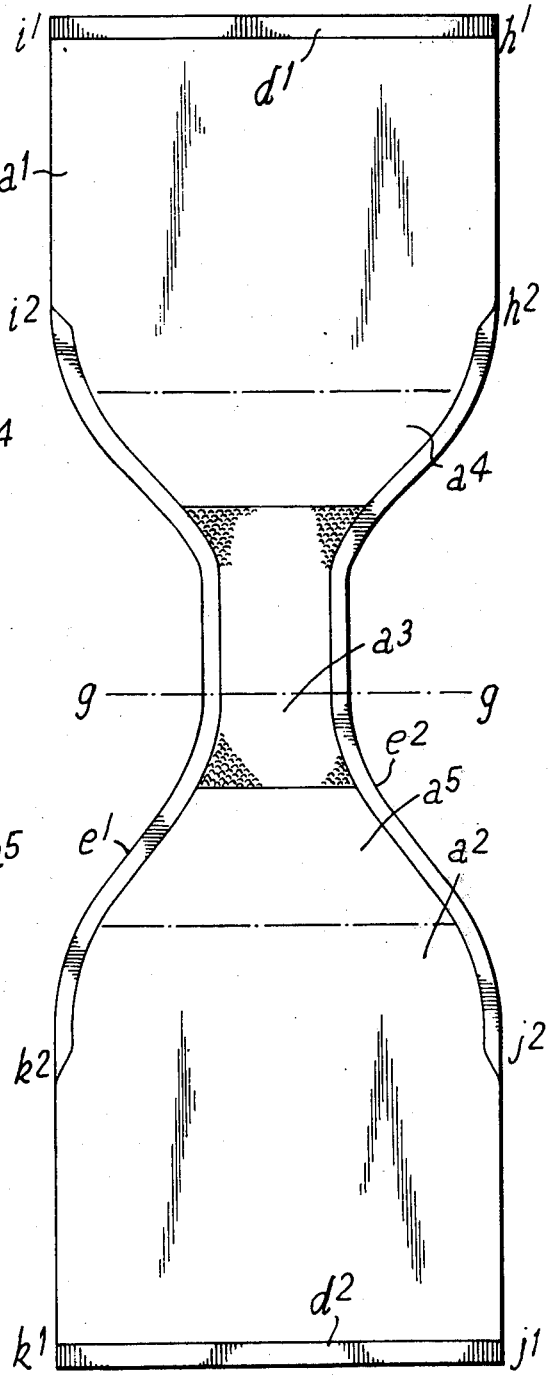
Figure 3:
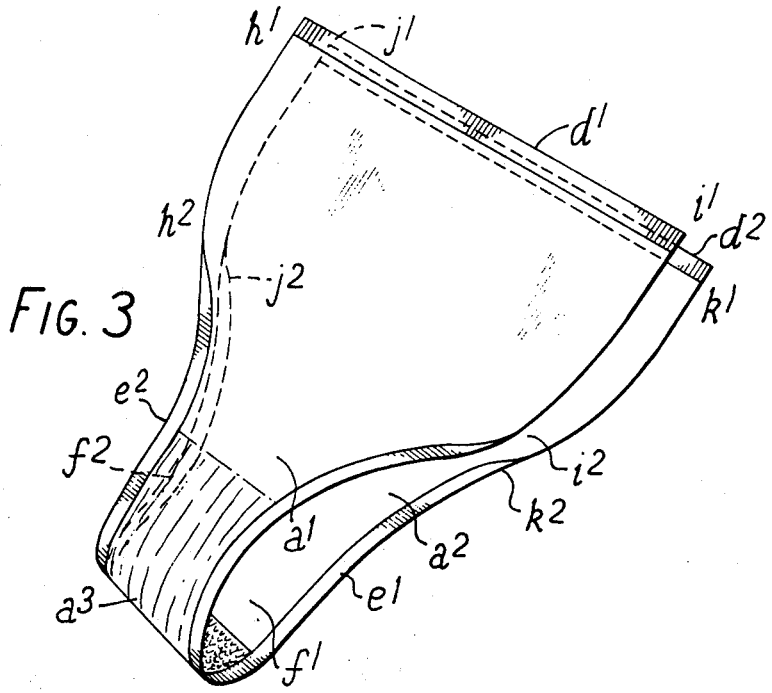
Figure 4:
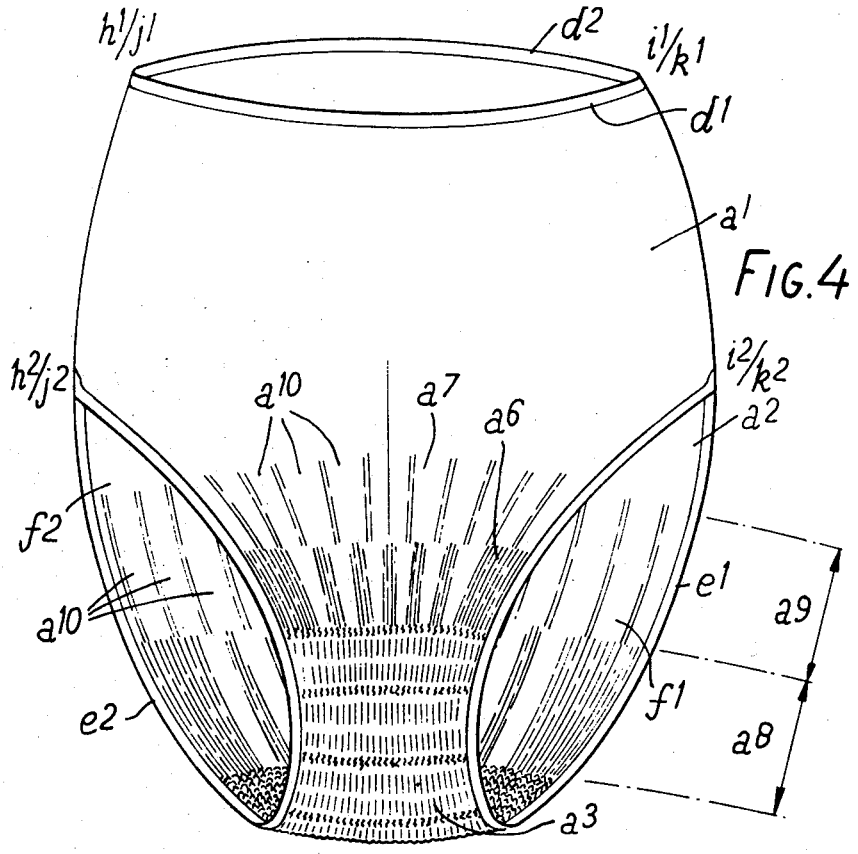
Figure 5:
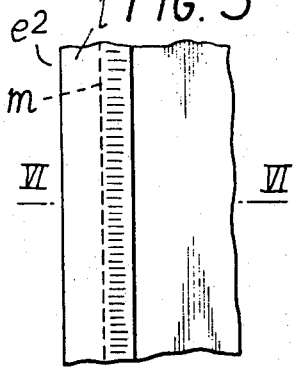
Figure 6:
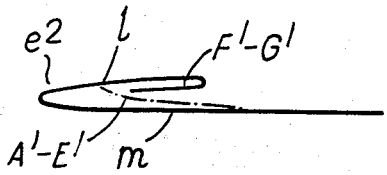
Figure 7:
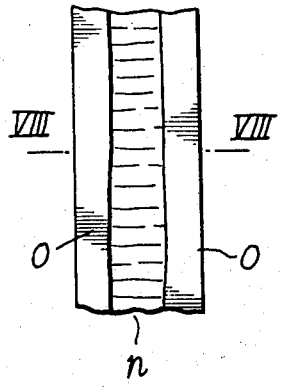
Figure 8:
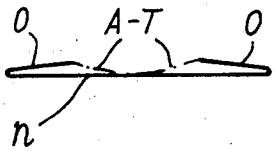
Figure 9:
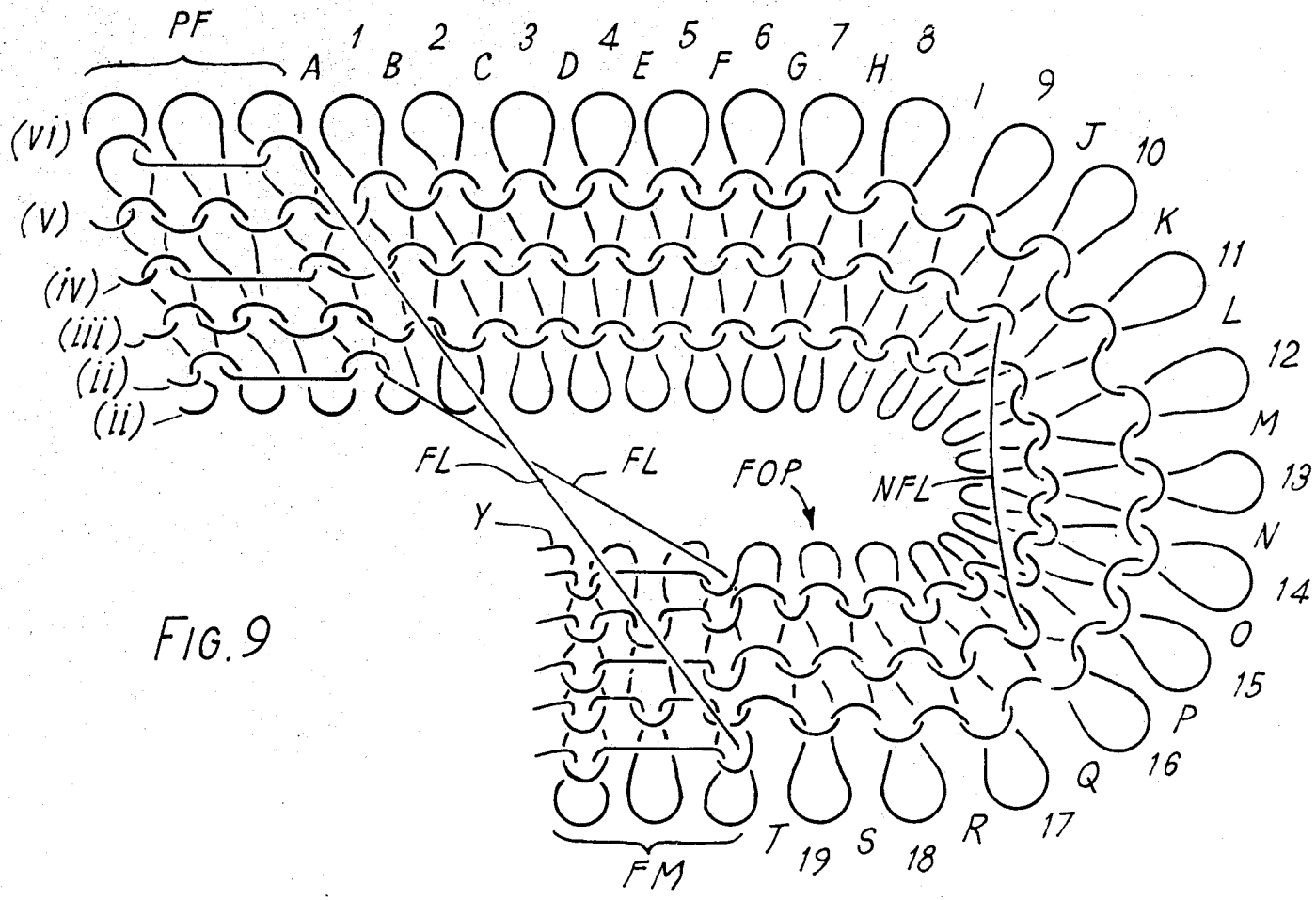
Figure 10:
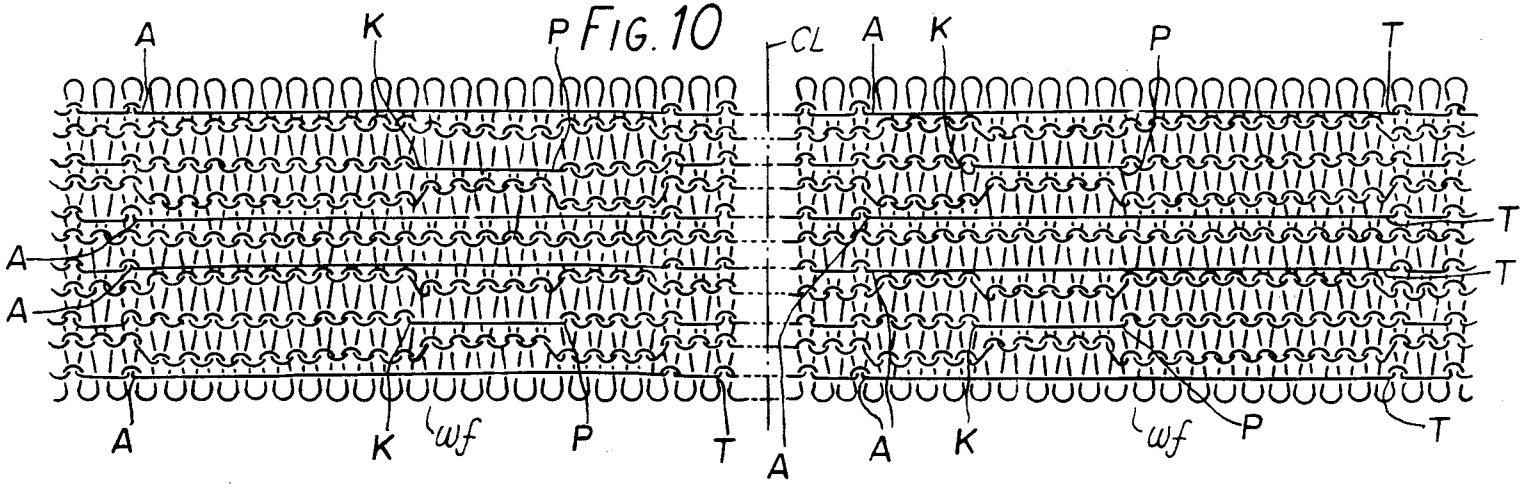
Figure 11:
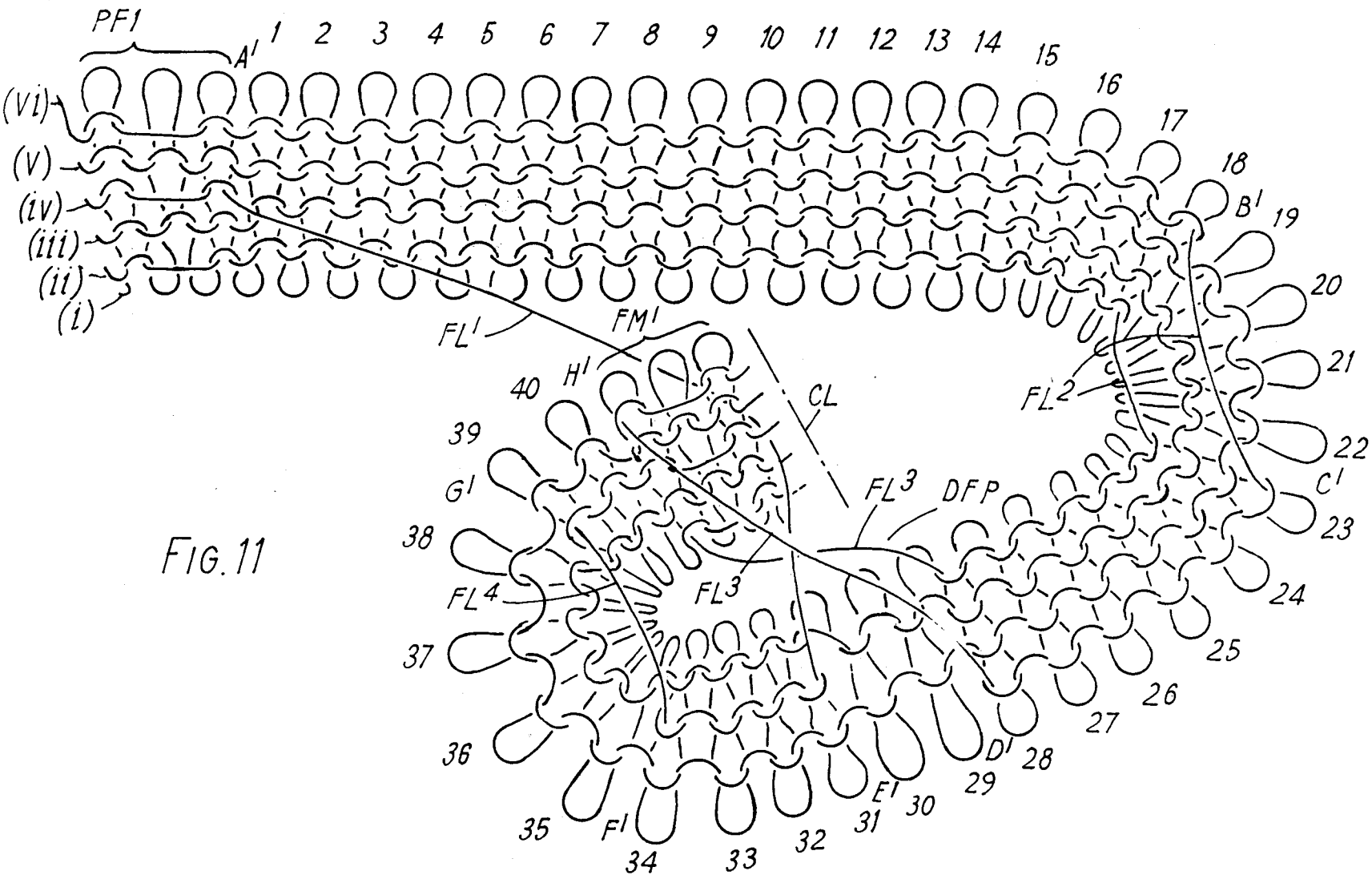
Figure 12A:
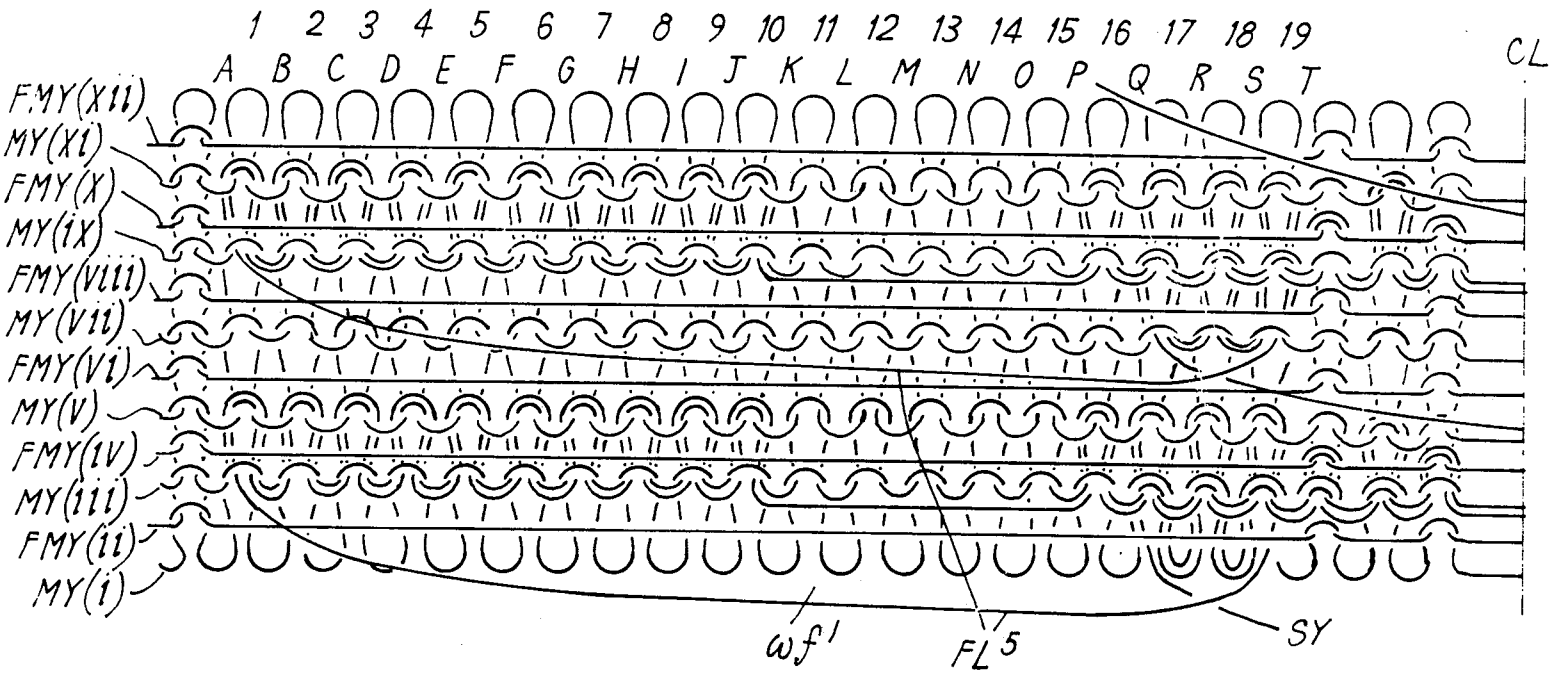
Figure 12B:
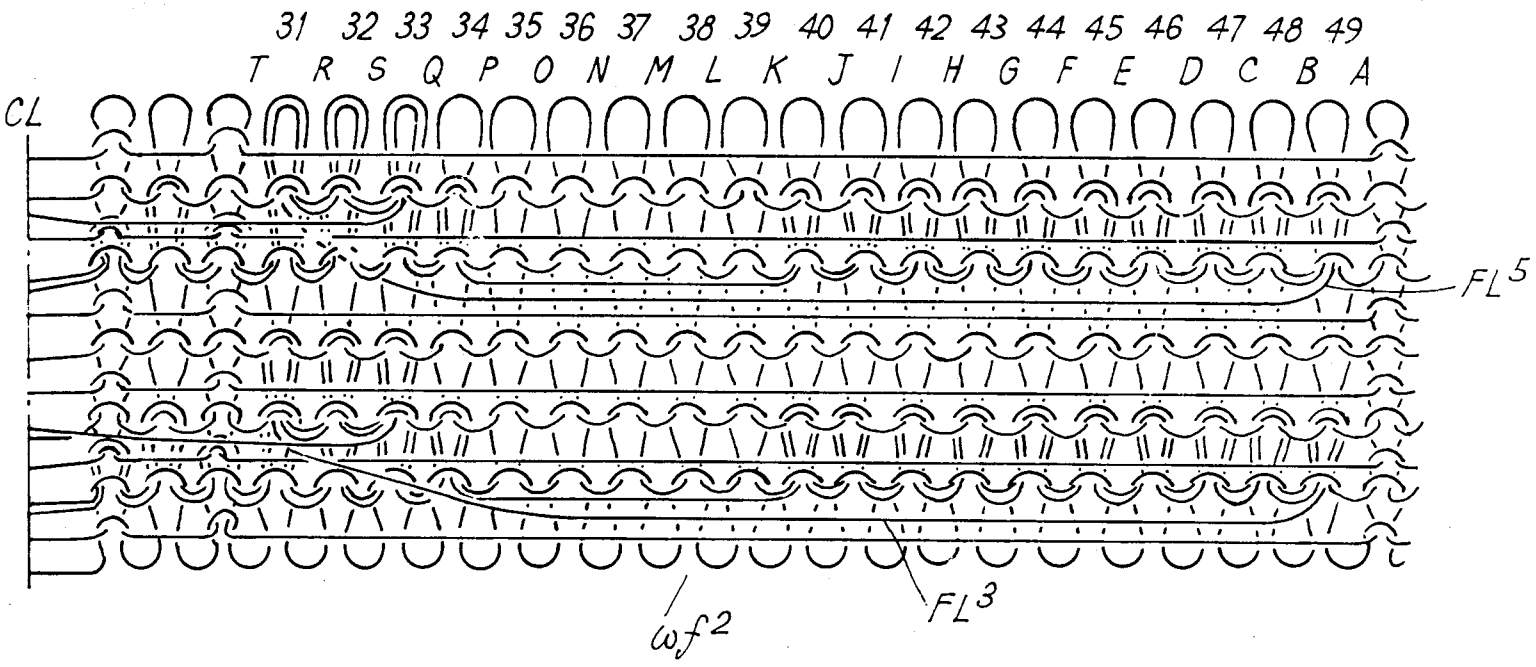

In order that the invention may be more clearly understood and readily carried into practical effect, specific examples of the folded over edge portions produced in accordance therewith and specific garments to which such free edge portions can be applied will now be described with reference to the accompanying drawings, wherein, FIG. 1 is a diagrammatic representation of a waisted preliminary tubular blank formed with a pair of folded over edge portions destined to define the edges of the leg openings of a pair of knitted briefs, FIG. 2 shows the inner side of the said preliminary tubular blank after it has been slit walewise from end to end and opened out to provide a final brief blank of flat form, FIG. 3 illustrates the flat blank folded in half as the first step in the conversion thereof into a pair of briefs, FIG. 4 is a front view of a made-up pair of such briefs — shown in perspective to assume the filled-out condition of the garment, as worn, and schemmatically illustrating how the garment can be fashioned, i.e. shaped, by selective knitting and floating, FIG. 5 shows the back of a fragmentary portion of knitted fabric having a double-folded free edge, as will be hereinafter described, FIG. 6 is a detail cross-sectional view of the same taken on the line VI — VI of FIG. 5 and drawn to a somewhat larger scale, FIG. 7 shows the back of a fragmentary portion of narrow elastic fabric which is neatened at each edge by a single folded walewise extending edge portion, FIG. 8 is a detail cross-sectional view of the same taken on the line VIII — VIII of FIG. 7 and drawn to a larger scale, FIG. 9 is a purely diagrammatic showing of the manner in which a single-folded walewise extending free edge portion may be knitted and anchored to the body of the fabric by the float threads, FIG. 10 shows, to a greatly magnified scale the back of the loop structure and floats in portions of a pair of side-by-side walewise extending single-folded over edges, FIG. 11 is a view similar to FIG. 9 showing how a double-folded edge is knitted and anchored by the float threads, FIGS. 12A and 12B are respectively the left and right hand parts of a loop diagram similar to FIG. 10 showing the introduction of splicing yarns into walewise extending folded over edge portions to reinforce or/and elasticate the same.

Referring to FIG. 1, it will be seen that the waisted form of preliminary tubular blank $a$ therein illustrated has, as laid out flat, approximately the peripheral shape of an hour-glass. This blank, which is knitted wholly by rotary knitting, on a circular seamless hose machine, comprises two opposite end portions $a^1$ and $a^2$, a waisted portion $a^3$ located between these end portions and two intermediate portions $a^4$ and $a^5$ between the opposite ends of the waisted portion $a^3$ and the two end portions $a^1$ and $a^2$ respectively. The limits of the intermediate portions $a^4$ and $a^5$, lengthwise of the preliminary blank $a$, are indicated by pairs of horizontal chain lines. The diameter $b$ of the waisted portion $a^3$ is ideally only about one third of the maximum diameter $b^1$ of the end portions $a^1$ and $a^2$. It is to be noted that the combined lengths of the portions $a^1$ and $a^4$ are somewhat less than the combined lengths of the portions $a^2$ and $a^5$.

The waisted portion $a^3$ is achieved, as previously mentioned, by forming the tube $a$ at a location between its opposite ends with a coursewise constriction produced by the use of contrasting yarns of respectively different types or/and deniers in conjunction with stitch variations and possibly also changes in stitch quality. The simple preliminary tubular blank $a$ in the illustrated example may be of 70 denier flat, uncut face fabric, and the shaping of the blank may be by selective knitting and floating; for example, each of the intermediate portions $a^4$ and $a^5$ may be knitted on a $1 \times 1$ knit-float basis whereas the waisted portion $a^3$ may be knitted on a $6 \times 1$ knit-float basis, the floats being preferably created in alternate courses only.

The preliminary blank $a$ is knitted on all the needles of a circular set, with the exception of a succession of a few, e.g. eleven, of them which are caused to miss knit suchwise as to produce right from one end of the blank to the other a readily visible walewise extending cutting line $c$.

The terminal margins $d^1$ and $d^2$ of the end portions $a^1$ and $a^2$ of the blank $a$ are each constituted by a coursewise extending turned welt.

In accordance with the essential feature of the present invention, a pair of side-by-side walewise extending folded over edge portions $e^1$ and $e^2$, which flank respectively opposite sides of the cutting line $c$, are automatically formed on the preliminary tubular blank $a$ during knitting thereof.

The waisted preliminary tubular blank $a$ just described is converted into a final one-piece brief blank of flat form, such as that shown in FIG. 2, simply by slitting the preliminary blank walewise from end to end along the cutting line $c_2$ and opening it out flat. The opened-out end portions $a^1$ and $a^2$ now provide the front and back panels respectively of the ultimate briefs to be made up from the final flat blank, whereas the opened-out, and now straight, coursewise extending welts $d^1$ and $d^2$ are destined respectively to provide the front and the rear portions of the waistband of the made-up pair of briefs. The two initially side-by-side walewise extending folded over edge portions $e^1$ and $e^2$ are, as a consequence of slitting and opening out the preliminary tubular blank $a$, separated to provide neat and flat folded over free edges destined to define the leg openings $f^1$ and $f^2$ of the ultimate briefs. That is to say, the folded over edge portion $e^1$ constitutes a finished edge defining the left-hand leg opening $f^1$, whilst the folded over edge portion $e^2$ similarly constitutes a finished edge defining the right-hand leg opening $f^2$ (see FIG. 4) — these edges having no tendency to roll over or curl.

The waisted portion $a^3$ of the preliminary tubular blank $a$ is enhanced by incorporation of cotton yarn into evenly distributed courses thereof, this portion, when slit and opened out being destined to provide for the ultimate garment a crotch the inner surface of which (seen in FIG. 2) is composed of loops of cotton.

Accordingly, all that is necessary to convert the final flat brief blank illustrated in FIG. 2 into a pair of briefs is, firstly, to fold the front panel $a^1$ over along the line $g$ — $g$ so that it lies congruently upon the back panel $a^2$, as seen in FIG. 3, and secondly, to seam together the two edges $h^1 - h^2$ and $l^1 - l^2$ of the front panel $a^1$ to the two corresponding edges $j^1 - j^2$ and $k^1 - k^2$.

FIG. 4 purports to show, say, a 100 denier blank made-up into briefs similar to those shown in FIG. 3 but wherein every course of the portions $a^6$ and $a^7$ of the front panel $a^1$ and the portions $a^8$ and $a^9$ of the back panel $a^2$ is knitted throughout on a selective or non-uniform, e.g. 3 × 1 selective knit-float, basis, whereas the crotch $a^3$ patterned all over with a 7 × 1 knit-float or similar smocked effect. The areas designated $a^{10}$ may all be plain knitted and of a uniform quality.

If desired, the front panel $a^1$ may be reduced in width or/and stiffened in such a way as to dispose the seams $h^1/j^1 - h^2/j^2$ and $i^1/k^1 - i^2k/^2$ towards the front, i.e. away from and clear of the opposite sides, of the briefs.

There will now be described practical ways of automatically producing, during knitting either of a garment or of a preliminary tubular blank from which such garment is made, a walewise extending folded over portions adapted to provide on the garment or blank a neat and flat free edge having virtually no tendency to curl.

First, there will be described, with reference to FIG. 9, a simple single folded over edge portion and a way of producing the same. In FIG. 9 this edge portion, for simplicity in illustration, is not portrayed in its final flat condition, but is opened out a little to show six courses of the knit structure. Moreover, instead of the folded over edge portion being shown edge on, as it would have to be to represent the fold most clearly, it is illustrated in perspective from above, looking down, so that all of the six courses (i), (ii), (iii), (iv), (v) and (vi) can be seen; of these courses, course (i) is the first and course (vi) the last to be knitted. The significant needle wales in FIG. 9 are consecutively numbered 1 –19. Points coincident with limbs of needle loops in these wales are lettered A –T. Let it be assumed that the wale spacings in the folded over edge are equal, and that the folded over edge portion is required to turn about wale 13. It is also assumed that the yarn Y floated in the margin of fabric adjoining the walewise extending folded over edge relaxes or recovers to such an extent that the floats are one third and length of the actual knitted width over which they are floated. To effect a fold in the fabric at or about wale 13, and to satisfactorily hold down the folded over portion FOP, it is essential that floats of such yarn Y shall extend from point A to point T. In fact, for simplicity, only two of these floats FL are shown — one in course (ii) and the other in course (vi). There could, however, if desired also be a float extending from A – T in course (iv). But to enhance the neatness and the flatness of the folded over portion FOP there may also be provided, in combination with floats FL extending from A –T, additional floats extending from any appropriate one or more of the following pairs of points: C – S, E – R, G – Q, I – P, K – O, M – N, L – P, K – R and J – T. However, to avoid confusion in FIG. 9 none of these particular additional floats have been drawn in. Moreover, to promote the fold and more sharply 'nip ' the fabric about the thirteenth wale 13 still further floats, like that indicated at NFL in FIG. 9, may extend, in appropriate courses such, for instance, as (ii), (iv) and (vi), from K – P.

It is to be clearly understood that it is purely for convenience that in FIG. 9 there are shown only two floats extending from A – T in courses (ii) and (vi) and only one float NFL extending from K – P in course (iv). Thus, in this particular folded over edge structure course (i), strictly within the confines of the folded over edge, is composed wholly of knitted loops; in course (ii) there are no knitted loops in wales 1 – 19 but simply a float FL extending from point A to point T; course (iii) is composed wholly of knitted loops; in course (iv) there are no knitted loops in wales 11 – 15 but merely a single float NFL extending from point P to point K; course (v) is composed wholly of knitted loops and in course (vi) there are again no knitted loops in wales 1 – 19 but simply another float FL extending from A to T. In FIG. 9, the fabric PF preceding the folded over portion FOP is 1 × 1 miss knitted in courses (ii), (iv) and (vi). Also, the fabric margin FM following the folded over portion FOP is also shown 1 × 1 miss knitted in courses (ii), (iv) and (vi) and is a safety margin. In the particular loop diagram constituting FIG. 10, there are in alternate courses of the portion of fabric *wf* at each side of the cutting line CL distributions of floats some extending from A – T and others from K – P, the latter being used to promote the fold and more sharply 'nip' the fabric as aforesaid. The illustrated distribution of these particular longer and shorter floats in each such portion of fabric *wf* is: A – T, A – T, K – P, A – T, A – T, K – P, and so on. In FIG. 10 the back of the fabric is shown, and the knitting progresses in the direction from the bottom to the top of the figure. It will also be realised that in FIG. 10 the two portions of fabric *wf* are, for diagrammatic purposes, shown in their initial flat condition prior to being folded over and anchored down.

In an alternative, the 'nip' in the fabric folded over about the 13 wale may be produced by floats extending from L – O.

If desired, each of the relatively small walewise extending folded over edge portions such as $e^1$ or $e^2$ may be double folded in the sense that, as shown in FIGS. 5 and 6, it has an outer main fold *l* and an inner subsidiary fold *m* to reinforce and stiffen the free edge. One manner of forming such a double folded edge portion extending over 40 wales is illustrated in the diagram constituting FIG. 11. In this figure the significant needle wales are consecutively numbered 1 – 40. Points coincident with limbs of needle loops in certain wales are lettered $A^1$, $B^1$, $C^1$, $D^1$, $E^1$, $F^1$, $G^1$ and $H^1$. FIG. 11 is drawn in a similar way to FIG. 9. That is to say, the double folded edge portion DEP is not depicted in its final flat condition but is opened out to an extend sufficient to show clearly six courses of the knit structure: additionally, the said double folded edge portion is illustrated in perspective — looking down from above. It is assumed that the wale spacings in the portion DFP are equal and that the latter is required to turn both about wales 20 – 21 and also about wales 36 – 37. It is also assumed that the yarn folded in the double folded edge portion DFP relaxes or recovers to such an extent that the floats are one third the length of the actual knitted width over which they are folded.

To effect a first fold in the fabric, at or about wales 20 – 21, and to satisfactorily hold down the said fold, it is essential that floats of the yarn shall extend from point $A^1$ to point $E^1$. For clarity's sake only one such float is indicated at $FL^1$ in course (iv). But to enhance the neatness and flatness of the first fold there are also provided floats $FL^2$ extending from point $B^1$ to point $C^1$, two of such floats in courses (ii) and (vi) being shown in FIG. 11. Similarly, to effect a second fold in the fabric at or about wales 36 – 37 and to satisfactorily hold down such second fold it is essential that floats $FL^3$ of the yarn shall extend from $D^1$ to $H^1$. To enhance the neatness and flatness of the second fold there are also floats, such as that indicated at $FL^4$, extending from $F^1 - G^1$. Accordingly, in the double folded structure illustrated in FIG. 11 there are floats FL extending from $A^1 - E^1$, combined with floats $FL^2$ extending from $B^1 - C^1$, and floats FL3 extending from $D^1$ to $H^1$ combined with floats $FL^4$ extending from $F^1$ to $G^1$.

Within the confines of the double folded edge portion course (i) is composed wholly of knitted loops. In course (ii) there are no knitted loops in, but floats extending across, wales 19 - 22 and 29 - 40. Course (iii) is composed wholly of knitted loops. In course (iv) there are no knitted loops in, but floats extending across wales 1 - 30 and 35 - 38. Course (v) is composed wholly of knitted loops and in course (vi) there are again no knitted loops, in, but floats extending across, wales 19 - 22 and 29 - 40.

The fabric $PF^1$ preceding the double folded edge portion DFP in FIG. 11 is shown 1 × 1 miss-knitted in courses (ii), (iv) and d (vi), and the fabric $FM^1$ following DFP through the cutting line CL is also shown 1 × 1 miss-knitted in courses (ii), (iv) and (vi) to provide a safety margin.

In FIGS. 7 and 8 there is shown a fragmentary portion of narrow elastic fabric *n*, e.g. for use as a garment strap, which is finished and neatened at each longitudinal edge by a single folded over edge portion O. At alternate courses of each folded over margin of the fabric there are floats of yard extending, in the manner shown in FIG. 9, from A - T;

Garment straps such as those shown in FIGS. 7 and 8 can conveniently be made on a circular hose knitting machine by a process of reciprocatory knitting over a small arc at a single feed. Each folded over margin of the narrow elastic fabric *n* may, if desired, also include all-knitted courses in which splicing is introduced.

Generally speaking, in a case where it is of no consequence that the formation of folded over edge portion reduces the stretch of the edge fabric in a walewise direction, the margin to be pulled over and folded down may be knitted wholly of a single yarn (per feed), in which instance the knitting operation may be such as to avoid taking and knitting the said yarn in alternate courses. In this case, of course, the knitted loops across which the floats extend are elongated walewise to the extent of two courses.

However, and as will be appreciated from the foregoing description, in an alternative case in which it is desired to maintain full stretch of the edge fabric in a walewise direction, the said margin to be pulled over and folded down may be wholly knitted to two yarns (per feed) only one of which yarns is floated over the desired number of wales in alternate courses, thereby leaving in the margin full courses of the unelongated knitted loops — albeit that some of the latter are double loops formed of both yarns and the remainder are single loops formed of one yarn only. In this alternative construction both of the yarns may be either of the same kind or of respectively different kinds.

Broadly considered, any of the hereinbefore described walewise extending folded over edge portions may be formed at any appropriate edges of knitted garments. It is, however, principally the intention to form the said folded over portions at the edges of opening in knitted garments. Thus, such folded over portions may even be formed at the entrances to suitably disposed pockets.

Splicing to reinforce or/and elasticate walewise extending folded over edge portions defining free edges is essentially introduced at regularly spaced courses only of each folded over portion.

If the folded over edge portions adjoin light garment fabric, then the introduction of relatively heavy splicing may conveniently be relied on to impart to the fabric greater fullness which in turn, and by virtue of less relaxation, will result in the production of deeper walewise extending folded over edges.

When walewise extending folded over edge portions which define garment openings are formed by reciprocatory knitting, the said portions at respectively opposite sides of an opening can be knitted at different feeds each with its own main or ground and splicing yarns.

But in the case where a garment or a garment blank is knitted wholly by rotary knitting, then the latter may, if desired be so carried out that the yarns which are fed in at the relevant feeds and at appropriate places are knitted into walewise extending folded over edge portions all float, i.e. extend without being knitted, across the cutting line along which the circularly produced fabric is slit to provide an opening or openings. Thus, in this case, there are in effect produced by rotary knitting, as clearly shown in FIG. 1, two side-by-side walewise extending folded over edge portions which are readily separable simply by slitting in a walewise direction transversely across bridging floats, i.e. floats extending over the backs of the adjoining folded over edge portions.

By way of example, let it be supposed that during rotary knitting a splicing yarn fed in at one feed is successively fed into the same number of successive wales and that at each revolution of the machine the said yarn is allowed to pass uncut and to be taken up, then, depending on the number of feeds and the knitting structure, splicing will be knitted in at regularly spaced courses with unknitted portions of the splicing yarn at the back of the fabric extending successively from the last of the aforementioned number of wales on each spliced course to the first wale on the next spliced course. These connecting unknitted portions of splicing yarn will, in tending to contract into the body of the knitted fabric, effect a fold over in a similar manner to coursewise extending floats and such unknitted portions can be used independently of or in conjunction with floats.

The adoption of this method not only produces a neat fold, but also prevents the tendency for the cut ends of splicing furthest from the edge to become ragged and to creep.

Ideally, each of two walewise extending opposed edge portions will have its own splicing, but where this is impracticable one splicing yarn can be introduced into two inward and opposite folds in such a way that unknitted portions of the yarn connecting these folds initially extend transversely across the splicing line.

FIGS. 12A and 12B, hereinafter conjointly referred to as FIG. 12, show a loop diagram, generally similar to FIG. 10, but showing, in their initially connected and flat condition two portions $wf^1$ and $wf^2$ of fabric in regularly spaced courses of which splicing is introduced, the portions thus being shown prior to being cut and separated along a cutting line CL to enable their walewise extending free edge portions or margins to be folded over and anchored down by contracting float threads formed in the said fabric portions by miss-knitting.

The left-hand and right-hand fabric portions $wf^1$ and $wf^2$ respectively are circularly knitted at two feeds and thus are initially connected by floats of yarn through which the cutting line CL extends. In FIG. 12 the back of the fabric is shown and it has been knitted from left to right. The significant needle wales involved in the left-hand appropriately spliced float fabric portion $wf^1$ are successively numbered 1 - 19 whereas the corresponding needle wales involved in the similar right-hand spliced float fabric portion $wf^2$ are successively numbered 31 - 49. The points between which floats extend are, as in previously described figures of the drawings, lettered A - T. In this example, a main yarn MY is knitted at one of the aforementioned two feeds in courses (i), (iii), (v), (vii), (ix) and (xi), and a second main yarn FMY is selectively miss-knitted to form the floats extending from A - T at the other of the feeds in courses (ii), (iv), (vi), (viii), (x) and (xii).

A single splicing yarn SY is shown knitted and floated, to form the floats extending from K to P, throughout the fabric portions at both sides of the cutting line CL. The floats K - P, as in previous examples, are for the purpose of enhancing the nip of the folds. Accordingly, the fabric which is knitted from the two main yarns MY and FMY has floats A - T in alternate courses and is spliced by the introduction of a single and separate splicing yarn SY which is miss-knitted at appropriate places to form the 'nip' floats K - P. As will be appreciated, in each of the two fabric portions $wf^1$ and $wf^2$ the number of knitted loops in each wale, from the point A to the point T, is six, albeit that there are in all 12 courses of knitting. At the left-hand side of FIG. 12 these 12 courses are designated by Roman numbers (i) - (xii) and, for convenience only and to avoid confusion, the letters MY and FMY indicating the two main yarns are shown adjacent to the said Roman numbers to show which main yarns relate to which courses.

Considering these 12 courses, an analysis of the structure illustrated in FIG. 12 is as follows:

Course (i): between the points A and T the main yarn MY is formed into knitted loops in every wale and the knitted loops in wales 17 - 19 are spliced by the splicing yarn SY.

Course (ii): the main yarn FMY is miss-knitted in wales 1 - 19 and 31 - 49 to form floats extending from A - T in both fabric portions $wf^1$ and $wf^2$.

Course (iii): between the points A - T the main yarn MY is formed into knitted loops in every wale, and the single splicing yarn SY is knitted together with such loops in wales 1 - 10 and 16 - 19 at one side of the cutting line CL and in wales 31 - 34 and 40 - 49 at the other side of this line.

Course (iv): the second main yarn FMY is miss-knitted in wales 1 - 19 and 31 - 49 to form floats A - T.

Course (v): the main yarn MY is formed into knitted loops in all wales between points A and T at both sides of the line CL, and the splicing yarn SY is knitted together with loops of MY in wales 31 - 33.

Course (vi): the main yarn FMY is miss-knitted in wales 1 - 19 and 31 - 49 to form floats A - T.

Course (vii): the main yarn MY is formed into knitted loops in every wale between points A and T at both sides of CL, and the splicing yarn SY is knitted together with such knitted loops in wales 17 - 19.

Course (viii): the main yarn FMY is miss-knitted in wales 1 - 19 and 31 - 49 to form floats A - T.

Course (ix): the main yarn MY is formed into knitted loops in all wales between points A and T at both sides of CL, whereas the splicing yarn SY is knitted together with such loops in wales 1 - 10 31 - 34 and 40 - 49 at the other side thereof.

Course (x): the main yarn FMY is miss-knitted in wales 1 - 19 and 31 - 49 to form floats A - T.

Course (xi): the main yarn MY is formed into knitted loops in all wales between the points A and T at both sides of the line CL, and the splicing yarn is knitted together with such knitted loops in wales 31 - 33.

Course (xii): the main yarn FMY is miss-knitted in wales 1 - 19 and 31 - 49 to form floats A - T.

The splicing yarn SY is progressively re-introduced into a course ahead of where it was last knitted in the previous course, and, with correct take up of said splicing yarn, relatively long floats $FL^5$ of the latter as also shorter floats extending from the point K to the point P will automatically be formed in both portions of fabric $wf^1$ and $wf^2$. The floats K - P enhance the 'nip' of the folds produced when the portions $wf^1$ and $wf^2$ are separated by slitting along the cutting line CL. Naturally, the slitting action also severs the splicing yarn, the uniform cut ends of which become encompassed by the folds.

The main yarns in the FIG. 12 structure may be 70 denier S-and Z- twist yarns, whilst the splicing yarn may be a double covered elastomeric yarn.

A float of the splicing yarn SY is, of course, formed wherever this yarn miss-knits between one group of spliced knitted loops and another such group of loops spaced therefrom in the same source.

It will be appreciated that even in spliced plain fabrics, floats of splicing yarn can be introduced to produce folded edges.

I claim:

1. A knitted garment having a walewise extending free edge portion comprising a plurality of courses of loops knitted of relaxable yarn and disposed in a predetermined number of uniformly spaced wales, the outer free margin of said portion and also an inner margin which follows the latter and is contiguous with the body of the garment being each miss knitted at at least one wale in each of spaced ones of the courses, and the relaxable yarn being floated inwardly and coursewise across successions of wales located between said two margins in each of the same spaced courses, the defined knit structure being such that the coursewise extending floats, in a relaxed condition and contracted into the body of the fabric, anchor to the latter a flat fold produced, consequent upon contraction of said floats, by the turning over and down of the marginal edge fabric about a predetermined one of the aforementioned wales located between said two margins, the thus folded over edge portion extending at right angles to and across the courses.

2. A knitted garment according to claim 1, wherein at least some of the coursewise extending floats are floated across all of the succession of wales located between the said two margins.

3. A knitted garment according to claim 1, wherein in courses of the walewise extending free edge portion other than those having floats extending across successions of wales located between two margins there are relatively short additional floats of the relaxable yarn which extend across the predetermined one of said wales about which the marginal edge fabric is turned over and down, these additional floats being so contracted into the fabric that they sharply nip the fabric in the region of the fold.

4. A knitted garment having a walewise extending free edge portion comprising a plurality of courses of loops knitted of relaxable yarn and disposed in a predetermined number of uniformly spaced wales, the outer free margin of said portion and also an inner margin which follows the latter and is contiguous with the body of the garment being each miss knitted at at least one wale in each of spaced ones of the courses, and the knit structure also having in appropriate ones of the said spaced courses (a) inwardly and coursewise extending first floats of the relaxable yarn which extend across a succession of the wales located between the aforesaid inner margin and a first point short of the outer free margin, these first floats, in a relaxed condition and contracted into the body of the fabric, serving to anchor to the latter an outer main fold produced, consequent upon contraction of said first floats, by the turning over and down of the fabric about predetermined ones of the wales located between the inner margin and the said first point short of the outer free margin and (b) relatively shorter coursewise extending second floats of the relaxable yarn which extend across another succession of the wales located between the outer free margin and a second point near to the aforementioned first point, the said second floats, in a similar relaxed condition and contracted into the body of the fabric, serving to anchor to the inner face of the main outer fold, and inner subsidiary fold produced, consequent upon contraction of said second floats, by the turning over and down of fabric adjoining the free edge about predetermined ones of the wales located between the outer free margin and the said first and second points, the inner subsidiary fold serving to reinforce and stiffen the free edge, and the thus double-folded edge portion extending at right angles to and across the courses.

5. A knitted garment according to claim 3, wherein at the locations where the fabric is turned over and down to produce the two folds there are relatively short additional floats of the relaxable yarn which extend across said predetermined ones of the wales, these additional floats being so contracted into the fabric that they sharply nip the fabric in the regions of the folds.

6. A garment blank produced by rotary knitting which blank, prior to making up into a garment, has two side by side walewise extending free edge portions which are initially flat, each of said portions comprising a plurality of courses knitted of relaxable yarn and disposed in a plurality of uniformly spaced wales, the opposed outer free margins of said portions and also inner margins of the same which are contiguous with the body of the blank being each miss knitted at at least one wale in each of spaced ones of the courses, and the relaxable yarn being floated coursewise to provide not only first floats extending across successions of wales located between the said outer free and inner margins of the portions in each of the same spaced courses but also second relatively short 'nip' floats extending across predetermined wales in intervening courses, the knit structure including still further floats initially connecting the walewise extending free edge portions and the mid-points of which further floats are coincident with a cutting line, whereby consequent upon the said portions being separated by a cut along the cutting line the aforementioned first and second floats relax and contract into the body of the fabric to turn the opposed outer free margins over and down and to nip the same to produce flat folds which are anchored to the fabric and extend at right angles to and across the courses.

7. A knitted garment according to claim 6, wherein each of the initially flat and connected walewise extending free edge portions is knitted from two main yarns which are miss knitted in spaced courses to form the longer floats extending across successions of wales located between the outer free and inner margins of the portions and is spliced by a single and separate splicing yarn which is miss knitted at the appropriate places to form the relatively short 'nip' floats.

8. A preliminary seamless tubular knitted blank from which can be produced a knitted garment in the form of briefs the edge of each of the two leg openings of which is defined by a walewise extending folded over edge portion, said blank, which is formed by rotary knitting, being (i) waisted at a location between its opposite ends to provide a crotch portion of substantially reduced diameter, (ii) formed with a visible cutting line extending right from one end to the other of the blank and (iii) provided at opposite sides of the cutting line with a pair of straight side-by-side walewise extending free edge portions which are initially flat, each of said portions comprising a plurality of courses knitted of relaxable yarn and disposed in a plurality of uniformly spaced wales, the opposed outer free margins of said portions and also inner margins of the same which are contiguous with the body of the blank being each miss knitted at at least one wale in each of spaced ones of the courses, and the relaxable yarn being floated coursewise to provide not only first floats extending across successions of wales located between the said outer free and inner margins of the portions in each of the same spaced courses but also second relatively short 'nip' floats extending across predetermined wales in intervening courses, the knit structure including still further floats initially connecting the walewise extending free edge portions and the mid-points of which further floats are coincident with the cutting line, whereby when the seamless tubular blank is slit from end to end and opened out the initially connected wale-wise extending free edge portions will be separated and the first and second floats will relax and contract into the fabric to turn the opposed outer free margins over and down to nip the same to produce flat folds which are anchored to the fabric and extend at right angles to and across the courses, suchwise as to provide a final brief blank of flat form having the said separated folded over edge portions at opposite walewise extending edges of the same in readiness to define the leg openings of ultimately made up briefs.

9. A preliminary seamless tubular knitted blank from which can be produced a knitted garment in the form of a brief having two leg openings each of which is defined by a walewise extending folded over edge portion, said blank, which is formed by rotary knitting, being provided with (i) a pair of opposite end portions interconnected by an intervening crotch portion of substantially reduced diameter, (ii) a visible cutting line extending rectilinearly from one end to the other of the blank and (iii) a pair of side-by-side adjoining walewise extending portions respectively disposed to either side of said cutting line each of a predeterminedly limited coursewise width and of a wale-wise length extending through said crotch portion and into said opposite end portions of the blank to points spaced from the blank extremities, each of said side-by-side adjoining portions being knitted of relaxable yarn in successive courses extending across a predetermined number of uniformly spaced wales, said relaxable yarn being miss knitted in each of said adjoining portions at at least one wale in each of selected spaced courses thereof, the relaxable yarn of which each of said side-by-side adjoining portions is knitted being floated coursewise to provide not only first floats in the same selected courses extending across a first succession of wales located between the opposite marginal limits of each of said adjoining sections but also second relatively short 'nip' floats in intervening courses extending across a second succession of predetermined wales, the knit structure including still further floats which connect the corresponding marginal regions of said adjoining portions immediately adjacent to said cutting line and extend across said cutting line with their midpoints substantially coincident therewith, whereby when the seamless tubular blank is slit from end to end along said cutting line and opened out into flattened form each pair of said side-by-side adjoining portions will be separated from each other to allow said first and second floats to relax and contract into the fabric and so allow folding of each of said side-by-side portions upon itself and nipping of the folds together to provide the fabric with flat folded marginal edges extending at right angles to and across the courses of the fabric, suchwise as to provide a final brief blank of flat form having folded over edges in the regions of the flattened fabric which define the leg openings of the ultimately made up brief.

* * * * *